US005625442A

United States Patent [19]

Seki

[11] Patent Number: 5,625,442

[45] Date of Patent: Apr. 29, 1997

[54] FIXING DEVICE HAVING A CLEANING BLADE

[75] Inventor: Takayuki Seki, Tokyo, Japan

[73] Assignee: Ricoh Company, Ltd., Tokyo, Japan

[21] Appl. No.: 590,615

[22] Filed: Jan. 24, 1996

[30] Foreign Application Priority Data

Jan. 24, 1995 [JP] Japan ..... 7-009183

[51] Int. Cl.[6] ..... G03G 21/00

[52] U.S. Cl. ..... 399/327

[58] Field of Search ..... 355/283, 299; 118/60

[56] References Cited

U.S. PATENT DOCUMENTS 4,870,466 9/1989 Iida .
5,077,158 12/1991 Nakano .
5,182,601 1/1993 Hodoshima et al. .

FOREIGN PATENT DOCUMENTS 53-123147 10/1978 Japan .
59-87478 5/1984 Japan .
60-39065 2/1985 Japan .
61-132975 6/1986 Japan .
61-193169 8/1986 Japan .
1-135460 U 9/1989 Japan .
5-216371 8/1993 Japan .
5-224556 9/1993 Japan .
5-323822 12/1993 Japan .

*Primary Examiner*—Nestor R. Ramirez
*Attorney, Agent, or Firm*—Oblon, Spivak, McClelland, Maier & Neustadt, P.C.

[57] ABSTRACT

A fixing device includes a fixing roller which has a heater therein, a pressing roller which is in contact with the fixing roller, a cleaning roller which is in contact with and cleans the fixing roller, a blade which is in contact with the cleaning roller and scrapes toner or paper dust on the cleaning roller. The surface of the blade is coated with a resin containing an additive and the surface resistance value of the coating layer is 1×10 Ω or less.

6 Claims, 1 Drawing Sheet

FIXING DEVICE HAVING A CLEANING BLADE

BACKGROUND OF THE INVENTION

1. Field of the Invention

This invention relates to a fixing device which is used in an image forming apparatus such as a copying machine, plotter, laser printer or facsimile machine. The invention further relates to a cleaning blade which scrapes remaining toner from a cleaning roller provided in the fixing device.

2. Discussion of the Background

In Japanese laid open patent 61-193169, a fixing device which fixes toner on a paper sheet has a fixing roller which has a heat source therein, a pressing roller which contacts the fixing roller with pressure, a cleaning roller which is in contact with and cleans the fixing roller and a blade in contact with the cleaning roller and which scrapes attached toner from the cleaning roller.

In the fixing device, the temperature of the surface of the fixing roller is detected by a thermistor which controls the heat source to keep the temperature of the fixing roller surface high enough to soften or melt the toner.

The melted or softened toner is pressed into the fibers of a paper sheet by the fixing roller and pressing roller while the paper sheet is passed through the fixing and pressing roller. In general, a releasing agent is applied on a surface of a fixing roller to reduce the quantity of offset toner.

Toner on the paper sheets is nonetheless transferred onto the fixing roller. The toner transferred onto the fixing roller is negatively (minus) charged. Since the quantity of minus charges on the fixing roller is more than that of the cleaning roller, the toner with negative charge on the fixing roller is transferred onto the cleaning roller by electrostatic adhesion force of the cleaning roller and is scraped by a blade.

Since the blade is in contact on the cleaning roller coated with an insulator, the blade and the cleaning roller are charged by rotation of the roller, whereby the electrostatic adhesion force falls off. Accordingly, it is difficult to sufficiently remove toner from the fixing roller.

SUMMARY OF THE INVENTION

It is an object of the present invention to overcome the above and other problems encountered in the aforementioned art.

It is a further object of the present invention to provide a fixing device capable of removing toner from the fixing roller.

It is another object of the present invention to provide a fixing device capable of maintaining a high cleaning performance of the cleaning roller.

It is yet another object of the present invention to provide a fixing device capable of preventing the cleaning blade and cleaning roller from being charged.

The above-mentioned objects of the present invention are achieved by a fixing device which includes a fixing roller, a pressing roller which is in contact with the fixing roller, a cleaning roller which is in contact with the fixing roller to clean the fixing roller and a blade which is in contact with the cleaning roller to scrape toner from the cleaning roller. The blade is covered with a coating layer which is comprised of a fluorine resin containing an additive and has a surface resistance value of 1×10 Ω or lees. Accordingly, it is difficult for the blade and the fixing roller to be charged.

BRIEF DESCRIPTION OF THE DRAWINGS

Other objects and further features of the present invention will become apparent from the following detailed description when read in conjunction with the accompanying drawings, wherein.

DESCRIPTION OF THE PREFERRED EMBODIMENTS

Figure 1:
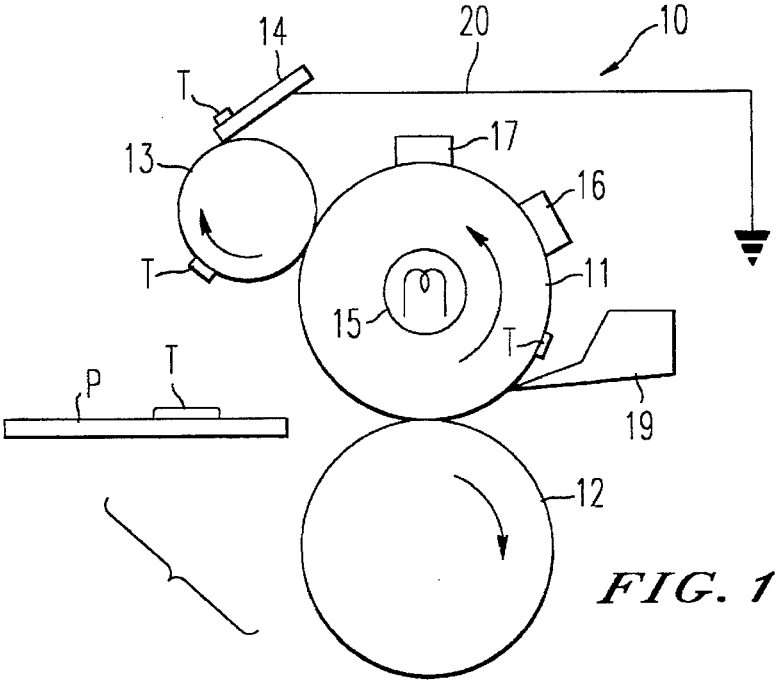
FIG. 1 is a cross-sectional view of a fixing device according to a first embodiment of the present invention.

Referring now to the drawings, wherein like reference numerals designate identical or corresponding parts throughout the several views, and more particularly to FIG. 1 thereof, there is illustrated a cross-sectional view of a fixing device according to a first embodiment of the present invention.

In FIG. 1, a fixing device 10 which is used for an image forming apparatus is made up of a fixing roller 11 having an electrical heater 15 as a heat source to melt toner T on a paper sheet P, a pressing roller 12 in pressing contact with the fixing roller 11, a cleaning roller 13 in contact with the fixing roller 11, a blade 14 in contact with the cleaning roller 13 for scraping adherents such as toner or paper dust on the cleaning roller 13, a separating pick 19 which separates the paper sheet P from the fixing roller 11 and a pair of discharging rollers (not shown) which discharge the paper sheet P separated from the fixing roller.

The toner T on the paper sheet P is charged negative by a developing device (not shown).

The fixing roller 11 has a core made of aluminum and a elastic sleeve made of silicone rubber. A thermistor 16 is in contact on a peripheral surface of the fixing roller 11 so as to detect the temperature of the fixing roller 11. Temperature information from the thermistor 16 is inputted to a controlling unit (not shown) which controls the heater 15 such that the temperature of the fixing roller 11 is kept at a predetermined value. Further, an excess temperature limit protection unit 17 is disposed on the fixing roller 11 to prevent the temperature from exceed a limit.

The fixing roller 11 is charged negative to reduce the quantity of toner T, charged by a charging unit (not shown), attached onto the fixing roller 11.

The pressing roller 12 mainly includes a core made of aluminum, etc. and a rubber sleeve made of silicone.

Figure 2:
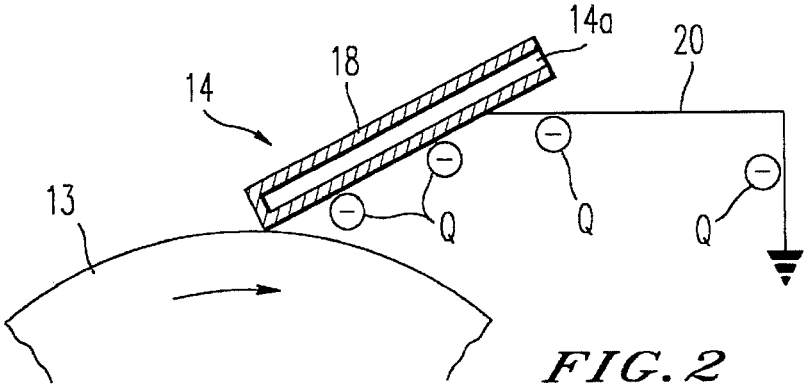
FIG. 2 is an enlarged cross-sectional view of the blade of FIG. 1.

The cleaning roller 13 is charged positive by a charging unit (not shown) to remove toner T attached on the fixing roller 11 by electrostatic adhesion force. It is possible to charge the cleaning roller 13 negative by a charged quantity less than that of the fixing roller 11. The blade 14 is in contact with the cleaning roller 13 and faces in the upstream direction relative to the rotation of the cleaning roller 13. The blade 14 is grounded and is made up of a supporting member **14*a* made of heat resistant resin and a coating layer 18 coated on the supporting member 14*a*, as shown in FIG. 2. The coating layer 18** comprises a fluorine resin containing an additive and has a surface resistance value of 1×10 Ω or less (measured by a Hairesuta measuring instrument and an HA Probe (Trademark)). A material which reduces electric resistance, such as carbon, is an example of the additive.

Negative charge Q, which is slightly created by friction between the blade 14 and the cleaning roller 13, is not accumulated on a surface of the blade 14 and the cleaning roller 13 because the charge Q is drained, via the coating layer and an electrically conductive member 20, to the ground.

Description of operation according to the above mentioned structure will be given below.

As shown in FIG. 1, The paper sheet P on which a toner image has been transferred by a (not shown) transferring device is transported to the fixing device 10. The paper sheet P with the toner T is inserted between the fixing roller 11, heated at the predetermined temperature by the control unit and the pressing roller 12, and the toner T is fixed on the paper sheet P. After that, the paper sheet P is separated from the surface of the fixing roller 11 by the separating pick 19 (FIG. 1) and discharged by the discharging rollers.

When the paper sheet P on which an image has been transferred contacts the fixing roller 11, toner T is offset onto the fixing roller 11. The offset toner T on the fixing roller 11 is transported into a contacting portion upstream of the cleaning roller 13. Since the cleaning roller 13 is charged with a positive polarity which is opposite to that of the toner T, the toner T attaches onto the cleaning roller 13.

When the cleaning roller 13 in contact with the blade 14 rotates, negative charges Q are generated slightly by friction between the cleaning roller 13 and the blade 14. The negative charges Q are drained via the layer 20 and the electrically conductive member 20. Thus, the negative charges Q are not accumulated on the surfaces of the blade 14 and cleaning roller 13 so that the toner T which attaches on the cleaning roller 13 is certainly removed by the blade 14.

Figure 3:
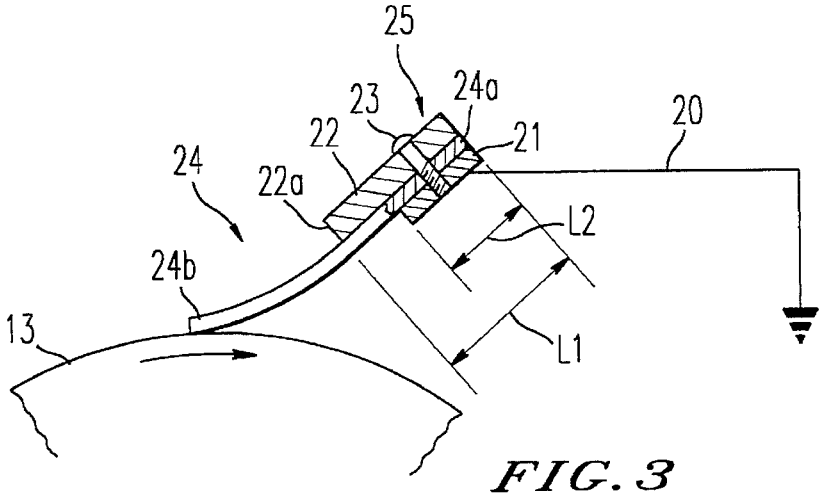
FIG. 3 is a cross-sectional view of another blade according to the present invention.

Another blade 24 is shown in FIG. 3. The blade 24 is fixed at an end portion 24*a* by a fixing member 25 and contacts the cleaning roller 13 at a free end 24*b*. The fixing member 25 is made up of a supporting portion 21, fixing plate 22 and screws 23 which unite the blade 24, the supporting portion 21 and the plate 22. The supporting portion 21 is mounted on a casing of the fixing device 10. The blade 24 is held between the fixing plate 22 and the supporting porion 21. At least two screws are provided in a longitudinal direction of the blade 24 (perpendicular to the pater sheet transporting direction).

The length L1 of the plate 22 in a direction which is perpendicular to the longitudinal direction of the blade 24 is longer than the length L2 of the supporting porion 21 in the direction which is perpendicular to the longitudinal direction of blade 24.

In this embodiment, the blade 24 is bent toward the cleaning roller 13 and is in contact with the cleaning roller 13. Since the free end 22*a* of the plate 22 is upstream of the plate 21, it is possible to contact the blade uniformly on the cleaning roller 13, thereby making it possible to uniformly drain charges which are created on the surface of the cleaning roller 13 into the blade 14. It is preferable that the plate 22 includes electrically conductive material to efficiently drain charges.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by letters patent of the United States is:

1. A fixing device comprising:

a fixing roller, a pressing roller in contact with the fixing roller, a cleaning roller in contact with the fixing roller for cleaning the fixing roller, and a blade in contact with the cleaning roller for scraping toner from the cleaning roller, wherein said blade is covered with a coating layer which comprises a fluorine resin containing an additive and has a surface resistance value of $1\times10\ \Omega$ or less.

2. A fixing device according to claim 1, wherein said blade is grounded via an electrically conductive material.

3. A fixing device according to claim 1, including a fixing member supporting an end of said blade opposite a free end of said blade in contact with said cleaning roller, said fixing member having a supporting portion and a fixing plate, said blade being held between said supporting portion and said fixing plate, wherein a length of said plate in a direction which is perpendicular to a longitudinal direction of said blade is longer than a length of said supporting portion in a direction which is perpendicular to said longitudinal direction of said blade, said blade being bent toward said cleaning roller.

4. A fixing device according to claim 1, wherein said additive is made of a material which lowers the electrical resistance value of said coating layer.

5. A fixing device according to claim 4, wherein said additive is made of carbon.

6. A fixing device according to claim 1, wherein said blade is grounded.

* * * * *